US005137224A

United States Patent [19]

Peters et al.

[11] Patent Number: 5,137,224

[45] Date of Patent: Aug. 11, 1992

[54] WINDING SPINDLE

[75] Inventors: Rudolf Peters, Lengerich; Rolf Kammann, Westerkappeln, both of Fed. Rep. of Germany

[73] Assignee: Windmoller & Holscher, Lengerich, Fed. Rep. of Germany

[21] Appl. No.: 642,317

[22] Filed: Jan. 15, 1991

[30] Foreign Application Priority Data

Jan. 15, 1990 [DE] Fed. Rep. of Germany ..... 4000923
Mar. 27, 1990 [DE] Fed. Rep. of Germany ..... 4009849

[51] Int. Cl.[5] ..... B65H 18/10; B65H 75/18
[52] U.S. Cl. ..... 242/56.9
[58] Field of Search ..... 242/56.9, 56.2, 56.3, 242/56.4, 56.5

[56] References Cited

U.S. PATENT DOCUMENTS 3,547,332 12/1970 Gaudin ..... 242/75.2 X
3,921,926 11/1975 Jores et al. ..... 242/56.9
3,934,833 1/1976 Nash et al. ..... 242/56.9
4,063,692 12/1977 Buggy ..... 242/56.9
4,854,518 8/1989 Yamazaki ..... 242/56.9

FOREIGN PATENT DOCUMENTS 3615479 11/1987 Fed. Rep. of Germany .

*Primary Examiner*—John M. Jillions
*Attorney, Agent, or Firm*—Fleit, Jacobson, Cohn, Price, Holman & Stern

[57] ABSTRACT

A winding spindle includes a plurality of support and drive rings mounted for free rotation thereon. The drive rings carry and drive winding cores, which have been slipped over the drive rings. The drive rings are able to be non-positively coupled, by their lateral annular flanks, with thrust washers. The thrust washers are connected, in a torque transmitting manner, and slidingly, with the winding spindle, and are acted upon by a thrust. In order to couple the support and drive rings to the winding spindle with an essentially constant torque along the length of the winding spindle, endless hose sections are associated with each thrust washer. The endless hose sections act to press the thrust washers directly against respective flanks of the support and drive rings with uniform force.

6 Claims, 4 Drawing Sheets

WINDING SPINDLE

BACKGROUND OF THE INVENTION

1. Field of the Invention

This invention relates to a winding spindle for simultaneously winding up a plurality of web strips alongside each other with the same web tension. The winding spindle includes a plurality of support and drive rings mounted for free rotation on the spindle. The support and drive rings are able to carry and drive winding cores, which have been slipped on the winding spindle. The winding cores are able to be non-positively coupled, by means of their lateral annular flanks, with thrust washers, which are connected slidingly and in a torque transmitting manner with the winding spindle, and are acted upon by a thrust.

2. Description of Related Art

In the winding spindle disclosed by German patent 3,615,479, a core support ring is gripped between two thrust rings. Between two adjacent support and drive rings, there is, in each case, a spacer sleeve supporting the same. A terminal thrust ring abuts, via a terminal thrust ring, on an annular collar on the winding spindle, while a thrust ring arranged on the other end of the winding spindles abuts against an actuating ring, which is subjected to a thrust in the axial direction by a tensioning means. Depending on the thrust applied by the tensioning means, the support and drive rings may be connected frictionally, via the thrust rings, with the winding spindle. However, since the thrust is applied from one end of the winding spindle via the actuating ring, owing to the friction of the elements (by which the thrust is transmitted) arranged in an axially sliding manner on the winding spindle, the thrust decreases from one support and drive ring to the next, so that the support and drive rings are coupled with the winding spindle in a manner involving decreasing friction and, thus, decreasing torque. In the known winding spindle, this phenomenon may be accentuated by the fact that, owing to the frictional engagement, or even positive interlocking engagement, of the support and drive ring, the winding core may impede the tensioning thrust applied via the actuating ring, to a greater or lesser extent. Consequently, the support and drive rings located at the opposite end of the winding spindle from the actuating ring will not be acted upon by a sufficiently powerful thrust from the associated thrust rings. Consequently, these support and drive rings tend to be connected with the winding spindle by an irregular and uncontrolled coupling.

Furthermore, in the winding spindle disclosed in German patent 3,615,479, a plurality of axial grooves are machined into the winding spindle at equal spacings about its circumferential face, in which a pressure hose is placed. The friction pads are applied to the inner wall side of the support rings, and thus transmit a torque to the support rings and to the winding core thereon. This application of radial thrust to the support rings, for the transmission of the torque necessary for winding, ensures a more even pressing of the frictional pads, and thus a more even torque, along the width of winding.

However a precondition for this is that all the support rings slipped onto the winding spindle must have a very accurately sized internal diameter. Major differences cause different frictional forces and, therefore, torques, since the frictional pads, which are not very flexible, are then applied with different forces to the inner wall of the support rings.

A further disadvantage of the radial action on the support rings is the different degree of wear of the frictional pads. If a certain size of material has been wound up for a prolonged period of time, the support rings which are in engagement are subjected to a larger amount of wear than the rings which have not been in engagement. If a different size of material, i.e., one which has a different effective width, is then wound up, the frictional pads are not able to come into such firm engagement with the inner wall face of the support rings at positions where there has been greater wear. This, in turn, leads to different amounts of torque in relation to the winding breadth.

A further disadvantage is that conventional combinations of frictional materials do not have a constant frictional behavior. In fact, when high torques are to be transmitted, stick-slip effects occur. Such stick-slip effects lead to vibrations of the winding spindle and, therefore, it is not possible to transmit the torque regularly. The vibrations may, in an extreme case, lead to an interruption of the clamping engagement with the winding core.

Satisfactory operation of the conventional winding spindle is possible if only a single winding core is held on it, because the core then evens out the torques transferred to it by the support and drive rings along its length. However, the total torque to be transferred by the support and drive rings to the winding core must be able to be reproducibly set, in order to not to exceed a certain tension of the web. Such a setting of the torque, leading to slip, is, however, not possible, if the holding force due to the actuating ring decreases in an irregular, uncontrolled manner from one thrust ring to the next.

Conventional winding spindles may have a length of 2 meters and bear approximately 50 support and drive rings distributed along their lengths. A plurality of winding cores with small breadths may be mounted on such a winding spindle. The webs may be wound up in a plurality of working widths. For example, webs could be formed by longitudinal slitting of the single web. The different widths would be wound with different degrees of hardness or compactness, owing to the different web tensions. There is even a chance of breakage of the webs, or of extreme sagging of the webs, if the individual winding cores are not properly coupled with the winding spindle, because of the application to the actuating ring of torques of different size.

Therefore, one object of this invention is to create a winding spindle of the type initially mentioned, with support and drive rings which are able to be coupled with the winding spindle along the length thereof with an adjustable torque, which is substantially the same for each support and drive ring.

SUMMARY OF THE INVENTION

In accordance with the invention, this object is achieved by providing presser means, preferably formed, at least in part, with an annular endless hose section associated with each thrust ring. The endless hose sections are operated so as to press the thrust rings directly against respective flanks of the support and drive ring unit. It is possible, therefore, for each thrust ring to be pressed, with predetermined axial force, against the flank of the support and drive ring associated with it so that a precisely reproducible torque transmitting action results. Accordingly, all the thrust rings on the winding spindle are coupled, with an essentially equal torque, to the winding spindle, so that it is possible to ensure equal web tension when a plurality of winding cores are mounted on the winding spindle in a plurality of effective working widths. Since each presser means acts directly on the thrust ring associated with it, irregular or uncontrollable frictional losses along the length of the winding spindle are eliminated. Axial movement of only the thrust washer, within the individual winding cores, takes place.

It is convenient if friction washers are placed between the thrust rings or washers and the flanks of the support and drive rings so that, on the basis of the equal coefficients of friction, such washers ensure, in a reproducible manner (assuming equal thrust action), that the support and drive rings are coupled with the spindle along the length thereof with torques of equal size. Additionally, according to the invention, bolster rings are locked, axially and rotationally, on the winding spindle. Such rings form counter-abutments for the presser means.

The winding spindle may further be provided with an axial bore for the supply of fluid under pressure, and connected with radial holes feeding the bolster rings. Furthermore each bolster ring bears an inflatable member e.g., an annular hose section or, alternatively, a piston and cylinder unit or the like, which bears on each bolster ring. The units are able to be supplied with fluid power medium via the radial holes.

In the preferred embodiment, the inflatable member consists of an annular hose section, arranged between the bolster rings and the thrust rings. The bolster and thrust rings may have the hose sections between them and fitting against annular faces. The annular faces, in cross section, are generally part circular.

Each bolster ring may be provided with annular faces for receiving a hose section on both sides thereof. This design, which is symmetrical in relation to the center plane of the bolster rings, leads to a particularly compact and convenient structure.

The support and drive rings are preferably mounted on the winding spindle to allow relative axial motion so that the thrust rings act on both sides of the support and drive rings with the same thrust.

BRIEF DESCRIPTION OF THE DRAWINGS

One working embodiment of the invention will now be described, making reference to the accompanying drawings.

DETAILED DESCRIPTION OF THE PREFERRED EMBODIMENT

Figure 1:
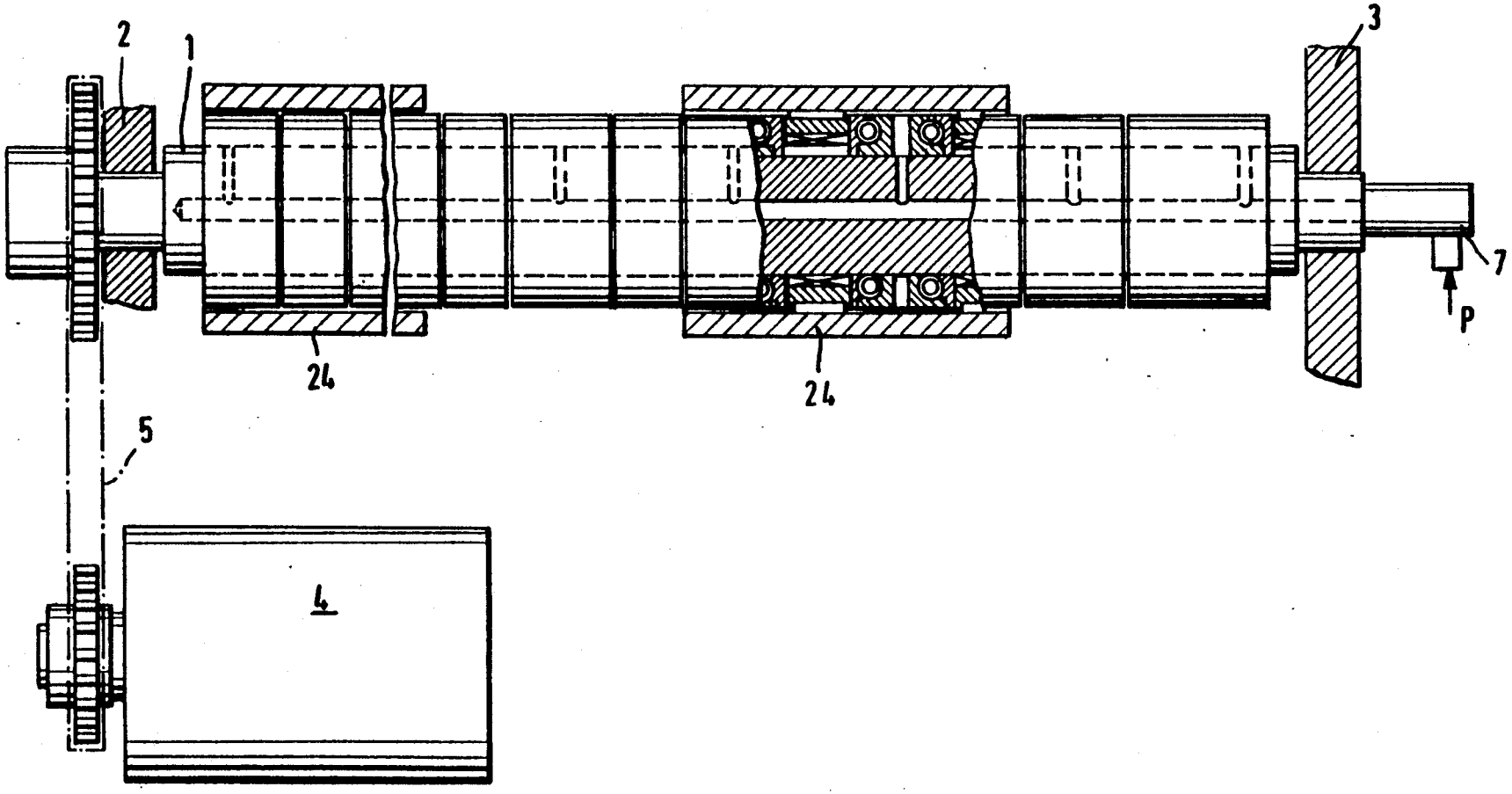
FIG. 1 is an elevational and partial sectional view of a winding spindle in accordance with the invention.
Figure 2:
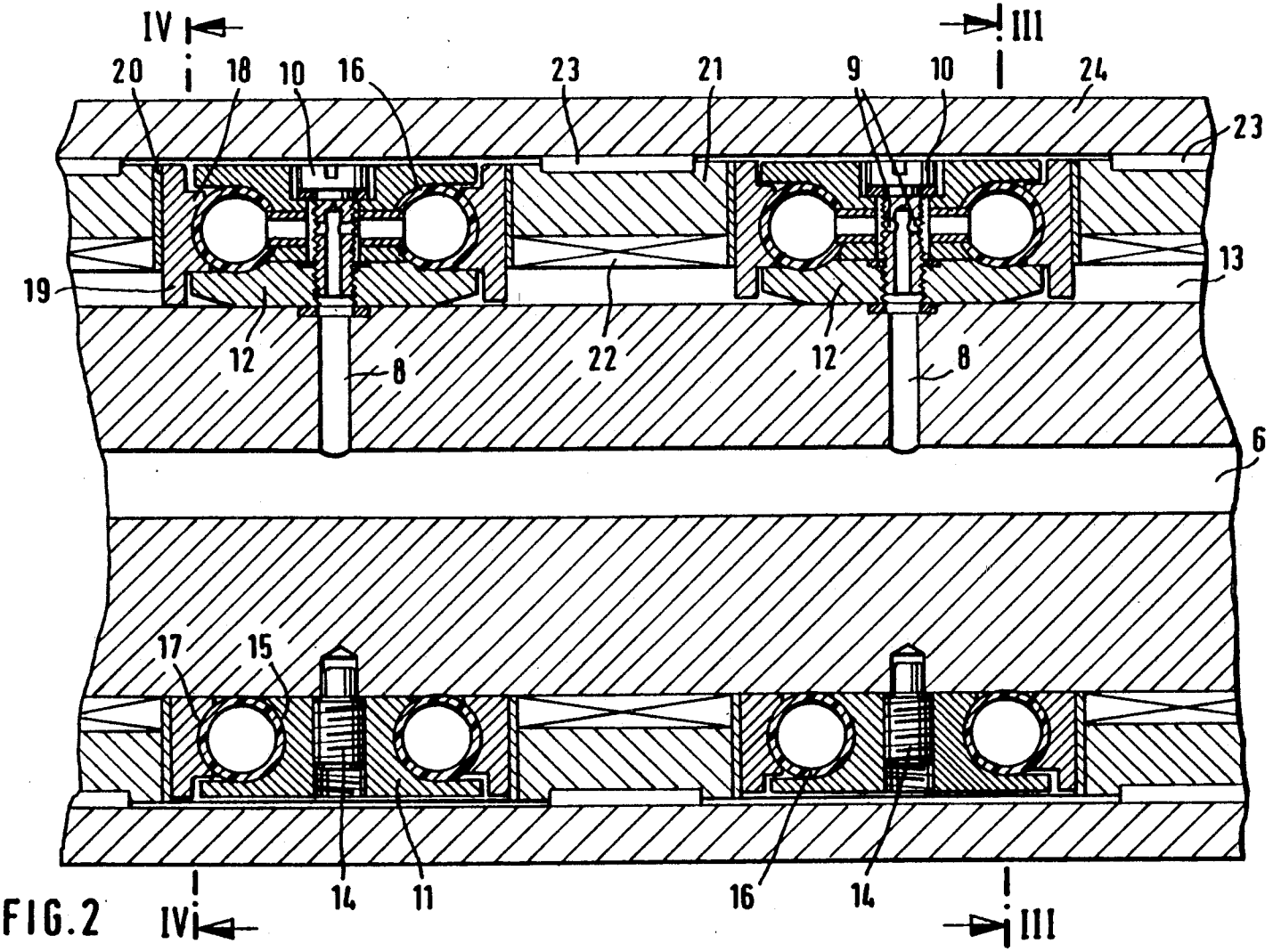
FIG. 2 is a longitudinal sectional view of part of the winding spindle shown in FIG. 1 on a larger scale.

The winding spindle of the present invention is mounted for rotation in two opposite side parts 2 and 3 of a frame, the remainder of which is not illustrated. A rotary electric motor 4 and a toothed drive belt 5 together form a drive for the winding spindle or, more specifically, the spindle shaft 1. As FIG. 1 illustrates, the output shaft of motor 4 has a drive gear provided thereon, about which belt 5 is disposed. Belt 5 is additionally disposed about a driven gear connected to spindle shaft 1. As is more particularly seen from FIG. 2, the winding spindle has an axially extending central bore 6 running along the full length thereof. Central bore 6 is connected, by a rotary lead-in fitting 7 (see FIG. 1) with a connection for the fluid power medium. Radial distributing holes 8 extend from this central bore and lead into axial distributing orifices 9 in hollow screws 10. By means of these hollow screws 10, bolster rings 11 are firmly screwed to keys 12. Each of the keys 12 is fitted into a continuous axial keyway 13 provided in the winding spindle shaft 1. The bolster rings 11 are, therefore, locked in a torque transmitting manner on the winding spindle shaft 1. In order to ensure that the individual keys 12 are not able to slide axially on the winding spindle shaft 1 together with the bolster rings 11, with which the individual keys 12 are associated, the spacer or bolster rings 11 are, in addition, secured to the winding spindle shaft 1 by means of threaded pins 14.

Figure 3:
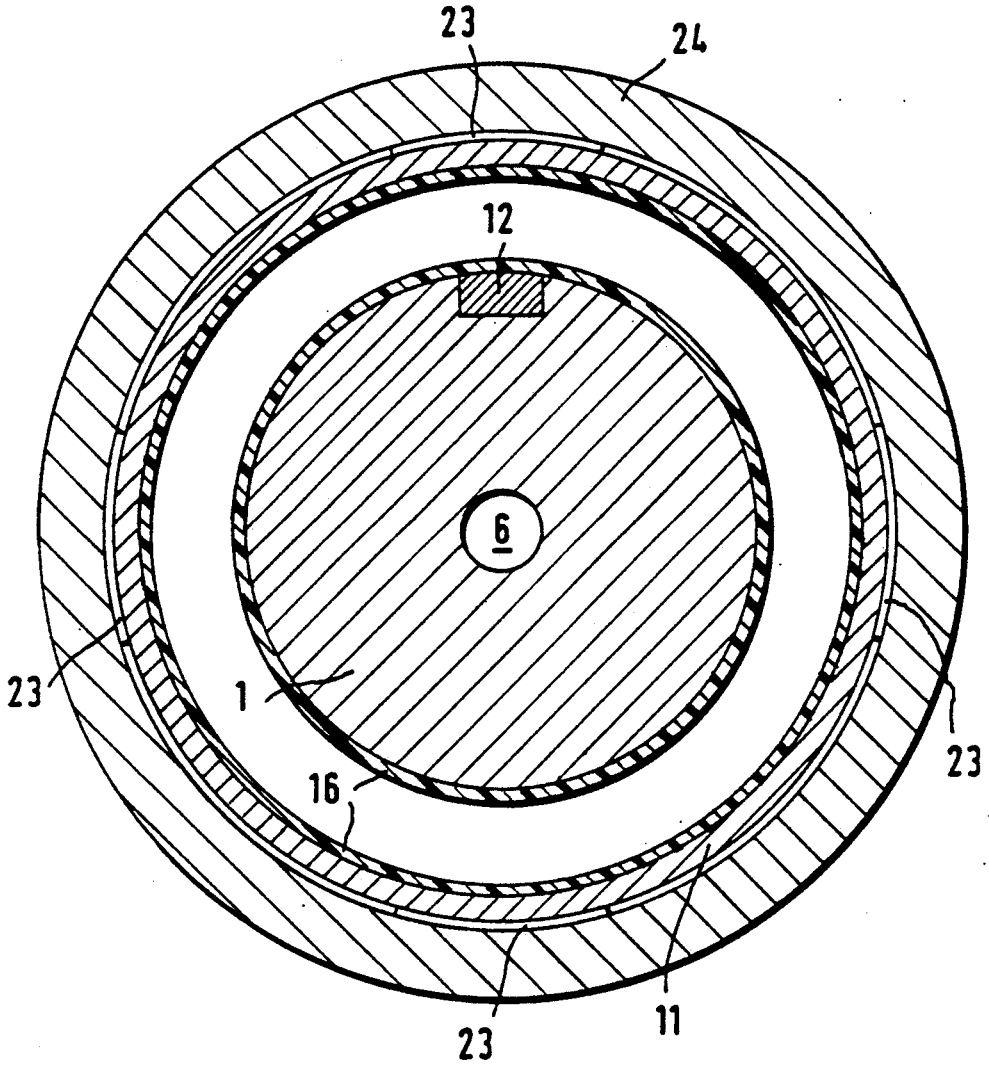
FIG. 3 is a sectional view of the winding spindle as seen along section line III—III of FIG. 2.
Figure 4:
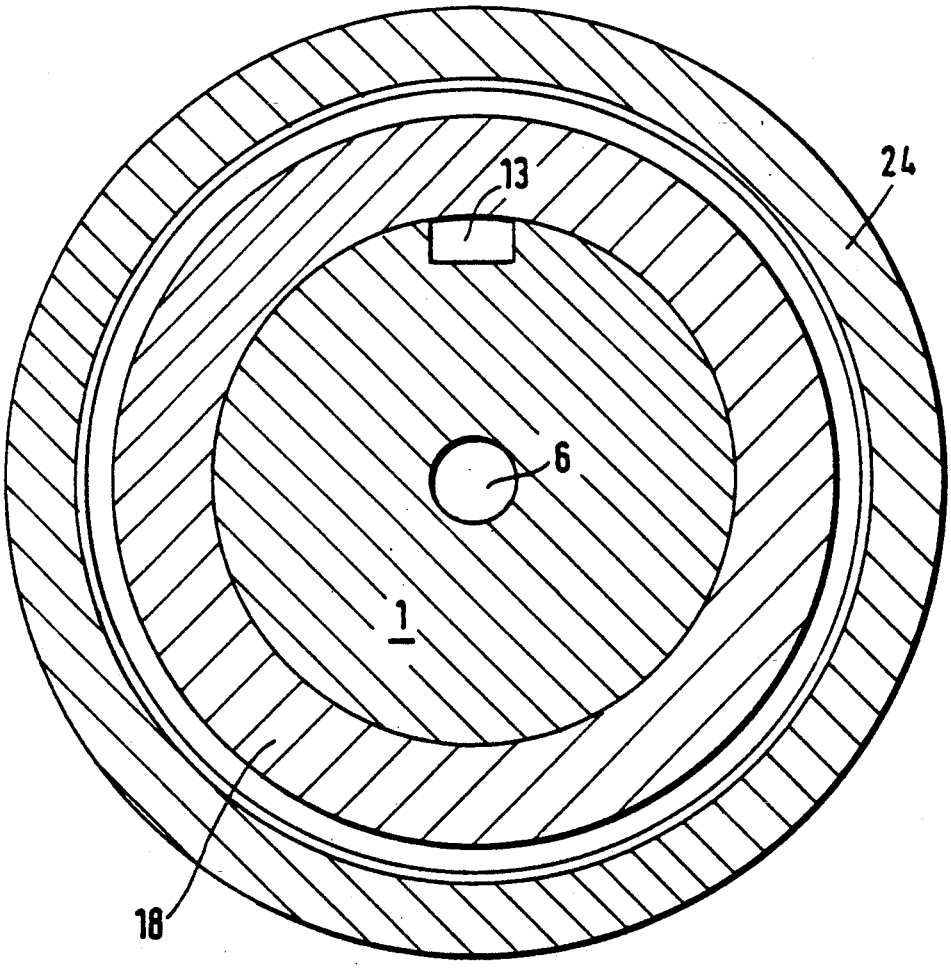
FIG. 4 is a sectional view of the winding spindle as seen along section line IV—IV of FIG. 2.

The bolster rings 11 have semicircular recesses 15, in which sections 16 of endless hose are placed. The endless hose sections 16 surround the winding spindle shaft 1, as is clear from FIG. 3. The surface portion of each endless hose section 16, i.e., that surface portion remote from a bolster ring 11, fits into a semicircular recess 17 provided in a thrust washer 18. As is clear from FIG. 2, each of the semicircular recesses 15 faces one of the semicircular recesses 17. The thrust washers 18 have keys 19, which, like the keys 12, fit into the continuous axial keyway 13. Thus, the thrust washers 18 are connected with the winding spindle shaft 1 in a torque transmitting manner. Frictional washers 20 abut radially extending faces of the thrust washers 18 which are remote from the bolster rings 11. The frictional washers 20 also abut the opposite sides of each of a plurality of support and drive rings 21 provided in keyway 13. These support and drive rings 21 are mounted on bearings 22 to freely rotate on the winding spindle shaft 1 and, in a conventional manner, have drive elements 23, by means of which the individual winding cores 24 are able to be connected with the support and drive rings 21 in either a non-positive, i.e., frictional manner, by a clutch arrangement, for example, or a positive i.e., interlocking manner, by a ratchet and pawl arrangement, for example. If, at this point, a fluid power medium, such as compressed air, is introduced, under pressure, into the central bore 6 via the connection provided in rotary lead-in fitting 7, such compressed air will inflate the individual endless hose sections 16 so that the clearance between the thrust washers 18 and the bolster rings 11 will be increased. Consequently, a frictional connection will come into being, the frictional connection being formed between the support and drive rings 21 and the thrust washers 18 via the frictional washers 20. Since the sections 16 of endless hose all have one and the same diameter, and the compressed air supplied is evenly distributed along the entire length of the winding spindle, all the thrust washers 18 are acted upon by the same force in the axial direction. Consequently, all of the support and drive rings 21 will be connected to the winding spindle shaft 1 with the same frictional force. Accordingly, there will be no unequal friction losses varying along the length of the winding spindle. Each of the support and drive rings 21 and individual winding cores 24, therefore, will be interconnected to the winding spindle shaft 1 by the same frictional force. Moreover, axial motion only takes place at the thrust washers 18 and the friction washers 20; no axial motion of the support and drive rings 21 themselves occurs. For this reason, the individual winding cores 24 can be either only frictionally connected with the support and drive rings 21, or partly connected positively to the support and drive rings by permitting the drive elements 23 to bite into the winding cores 24.

The preferred embodiment of the invention has been described above and illustrated in the drawing figures. However, it is to be understood that the invention is defined by the following claims, and is not limited to the preferred embodiment disclosed.

We claim:

1. A winding spindle comprising:

a winding spindle shaft;

a plurality of support and drive rings mounted for free rotation on said winding spindle shaft;

winding cores slipped on said support and drive rings;

thrust washers non-positively coupled, by means of lateral annular flanks thereof, with said winding cores, said thrust washers being connected slidingly with, and so as to transmit torque to, the winding spindle shaft, and being acted upon by a thrust;

pressing means associated with each thrust washer for applying said thrust, said presser means pressing the thrust washers directly against respective flanks of adjacent support and drive rings; and bolster rings locked, rotationally and axially, on the spindle shaft, said bolster rings forming abutments for the presser means, characterized in that the spindle shaft is provided with an axial bore for supplying a fluid power medium, said axial bore being connected with the bolster rings by means of radial holes, said presser means comprising inflatable members mounted on each bolster ring, said radial holes serving to supply fluid power medium to said inflatable members.

2. A winding spindle as claimed in claim 1, and further comprising a friction washer placed between each thrust washer and the flank of an adjacent support and drive ring.

3. A winding spindle as claimed in claim 2, characterized in that between two respective thrust washers and two friction washers, one support and drive ring is mounted.

4. A winding spindle as claimed in claim 1, characterized in that the inflatable members include annular sections of hose, which are placed between the bolster rings and the thrust washers.

5. A winding spindle as claimed in claim 4, characterized in that the bolster rings and the thrust washers contain the sections of hose therebetween, in recesses formed therein, said recesses having corresponding annular faces which are approximately part-circular.

6. A winding spindle as claimed in claim 5, characterized in that each bolster ring is provided with annular faces for hose sections on both sides thereof.

* * * * *